US010593236B1

(12) United States Patent
Bacallao et al.

(10) Patent No.: US 10,593,236 B1
(45) Date of Patent: Mar. 17, 2020

(54) LABEL HOLDER FOR COUPLING ELECTRONIC LABELS TO CONTAINERS AND ASSOCIATED METHODS

(71) Applicant: Walmart Apollo, LLC, Bentonville, AR (US)

(72) Inventors: Yurgis M. Bacallao, Centerton, AR (US); Jason D. Bellar, Bentonville, AR (US); Donald R. High, Noel, MO (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/548,169

(22) Filed: Aug. 22, 2019

Related U.S. Application Data

(60) Provisional application No. 62/722,365, filed on Aug. 24, 2018.

(51) Int. Cl.
*G09F 3/20* (2006.01)
*G09F 3/02* (2006.01)
*G09F 3/12* (2006.01)

(52) U.S. Cl.
CPC ..... *G09F 3/208* (2013.01); *G09F 3/02* (2013.01); *G09F 3/12* (2013.01); *G09F 3/201* (2013.01); *G09F 2003/0272* (2013.01)

(58) Field of Classification Search
CPC . G09F 3/208; G09F 3/12; G09F 3/201; G09F 2003/0272
See application file for complete search history.

(56) References Cited

U.S. PATENT DOCUMENTS 2,289,237 A 7/1942 Brown
3,984,279 A 10/1976 Siryj
4,966,643 A 10/1990 Turkki
(Continued)

FOREIGN PATENT DOCUMENTS

EP 0699587 3/1996
EP 2561967 2/2013

OTHER PUBLICATIONS

Alpesh Vaghela; "Semi Automatic Flat Bottle Labeling Machine, Manual Sticker Labeling Machine, Manufacturer, Supplier", https://www.youtube.com/watch?v=kvQ8rKCbvbU, published on Sep. 15, 2015, pp. 1-5.

*Primary Examiner* — Gary C Hoge
(74) *Attorney, Agent, or Firm* — Fitch, Even, Tabin & Flannery, LLP

(57) ABSTRACT

In some embodiments, a label holder for retaining an electronic product label and detachably coupling to a product container includes rear panel, a top panel and a bottom panel each movably attached to the rear panel and extending in a forward direction relative to the rear panel, and at least one container-gripping panel attached to the rear panel and extending from the rear panel. The rear panel, the top panel, and the bottom panel together define a channel therebetween configured to slidably receive and retain an electronic product label. The container-gripping panel includes a plurality of projections extending therefrom and configured to grip at least one wall of the product container to detachably couple the label holder to the product container. Methods of detachably attaching the label holder to the product container and methods of uncoupling the label holder from the product container are also described.

20 Claims, 6 Drawing Sheets

(56) References Cited

U.S. PATENT DOCUMENTS

| | | | | |
|---|---|---|---|---|
| 5,553,412 | A * | 9/1996 | Briechle | G09F 3/204 40/124.01 |
| 6,126,125 | A * | 10/2000 | Dalton | G09F 3/204 248/205.2 |
| 6,142,322 | A * | 11/2000 | Smith | A47F 5/0869 211/183 |
| 6,440,249 | B1 | 8/2002 | Swinburne | |
| 6,793,185 | B2 * | 9/2004 | Joliey | G09F 3/204 211/119.003 |
| 6,892,780 | B2 | 5/2005 | Vollm | |
| 8,168,033 | B1 | 5/2012 | Mohamad Nor | |
| 2003/0111580 | A1 * | 6/2003 | Catteau | A47F 5/0869 248/222.51 |
| 2009/0019743 | A1 * | 1/2009 | Nguyen | G09F 3/204 40/508 |
| 2010/0088937 | A1 * | 4/2010 | Lee | G09F 3/20 40/642.02 |
| 2011/0286195 | A1 * | 11/2011 | Horikiri | G09F 3/204 361/807 |

* cited by examiner

LABEL HOLDER FOR COUPLING ELECTRONIC LABELS TO CONTAINERS AND ASSOCIATED METHODS

CROSS-REFERENCE TO RELATED APPLICATION

This application claims the benefit of U.S. Provisional Application No. 62/722,365, filed Aug. 24, 2018, which is incorporated herein by reference in its entirety.

TECHNICAL FIELD

This invention relates generally to attachment of electronic product labels to product containers, in particular, to a label holder for retaining an electronic product label and detachably coupling to a product container.

BACKGROUND

It is becoming more and more common for retail stores and warehouses to label product containers with electronic (e.g., digital) labels instead of the conventional sticky paper labels. Such electronic labels typically have a plastic housing and a display screen, and are attached to the products by using an adhesive material (e.g., double-sided adhesive tape).

One disadvantage of the use of such adhesive materials to attach the electronic labels to the product containers is that the adhesive material is generally designed for a single use only, and is typically thrown away each time an electronic label is removed from a product container. As such, a new adhesive material has to be applied to the removed electronic label and/or to a second product container when this electronic label is to be reapplied to the second product container. Given the very large volume of stocking operations of certain retailers, the use of such adhesive material may be associated with a high cost. Another disadvantage of using an adhesive material such as a double-sided adhesive tape is that, when such an adhesive tape is removed from the product container, the adhesive tape may damage the product container (e.g., a cardboard-based product container) by ripping off an outer layer of the material from which the product container is made.

BRIEF DESCRIPTION OF THE DRAWINGS

Disclosed herein are embodiments of systems, apparatuses and methods pertaining to label holders for retaining an electronic product label and detachably coupling to product container. This description includes drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, label holders for retaining electronic product labels and detachably coupling to product containers are provided. In addition, methods of detachably attaching the label holders to the product containers and methods of uncoupling the label holders from the product containers are also described.

In some embodiments, a label holder for retaining an electronic product label and detachably coupling to a product container includes rear panel, a top panel and a bottom panel each attached to the rear panel and extending in a forward direction relative to the rear panel, and at least one container-gripping panel movably attached to the rear panel and extending from the rear panel. The rear panel, the top panel, and the bottom panel together define a channel therebetween configured to slidably receive and retain an electronic product label. The container-gripping panel includes a plurality of projections extending therefrom and configured to grip at least one wall of the product container to detachably couple the label holder to the product container. In some aspects, a method of detachably attaching the label holder to the product container comprises slidably inserting the electronic label into the channel such that the electronic label is retained in the channel, and bringing the label holder having the electronic label retained in the channel thereof into proximity to the product container until the projections of the container-gripping panel grip at least the top wall of the product container to detachably couple the label holder to the product container.

Figure 1:
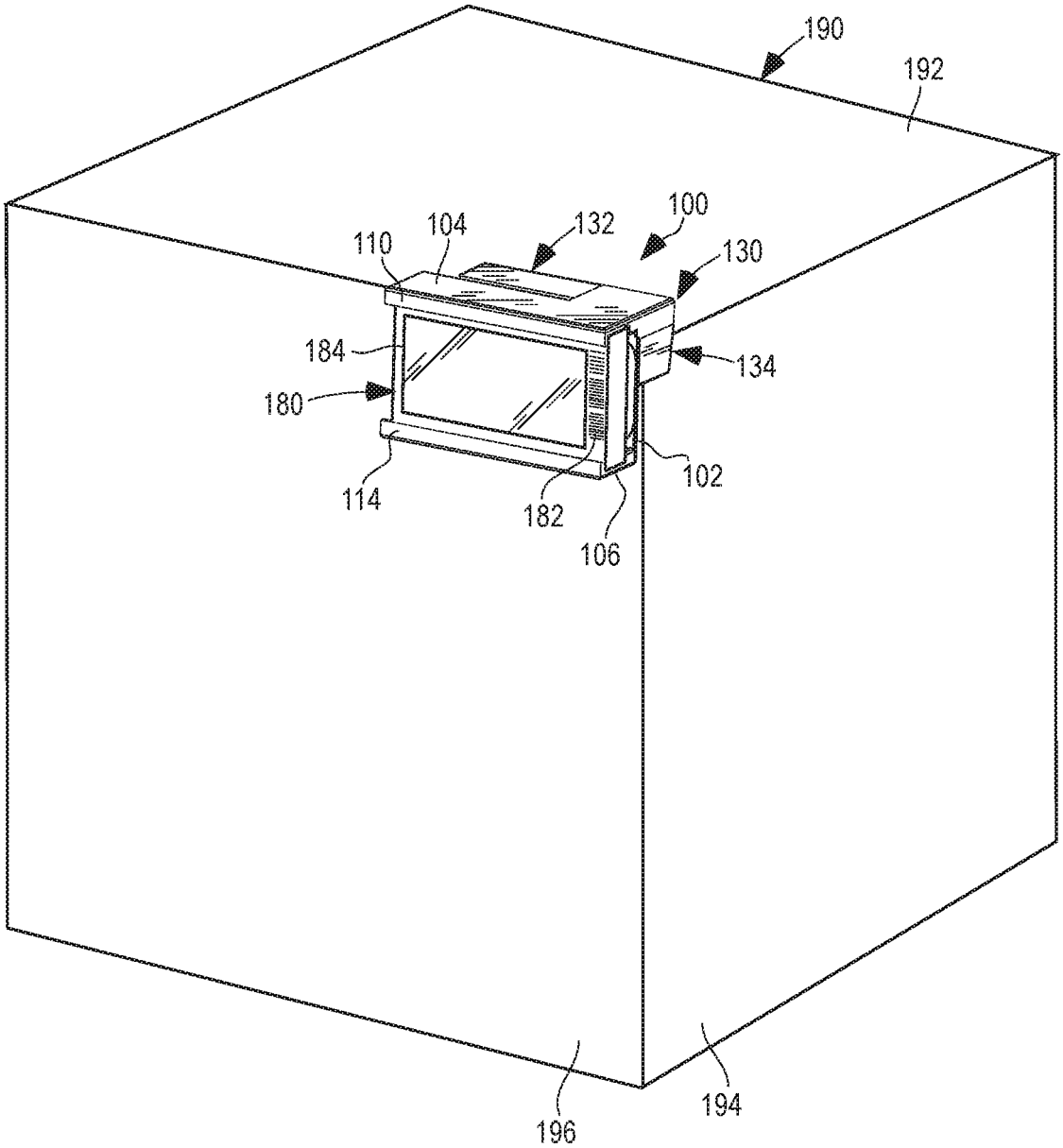
FIG. 1 is a front perspective view of a label holder in accordance with some embodiments, shown while retaining an electronic product label and being detachably coupled to a front wall and a side wall of the product container.
Figure 2:
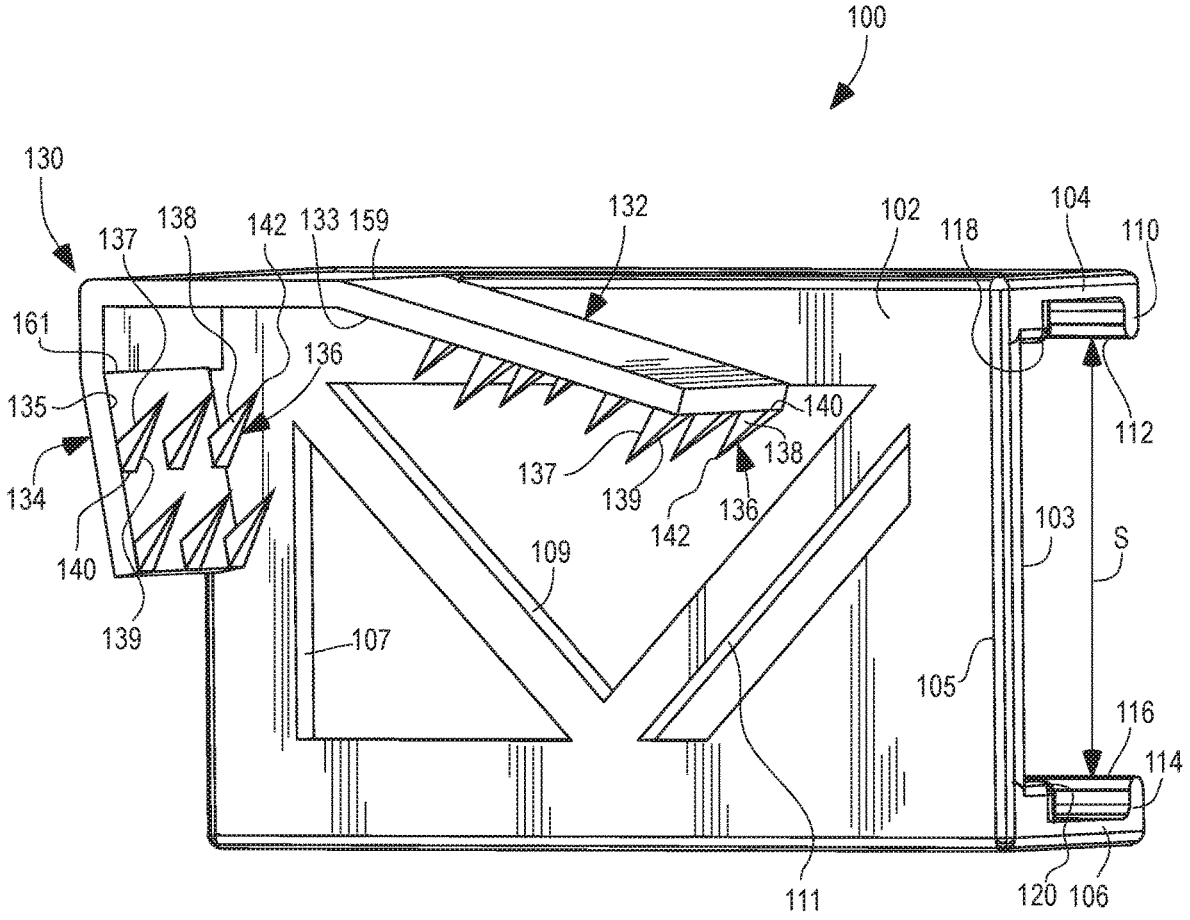
FIG. 2 is a rear perspective view of the label holder of FIG. 1, showing the product-gripping panel of the label holder and the product container-gripping projections extending therefrom.
Figure 3:
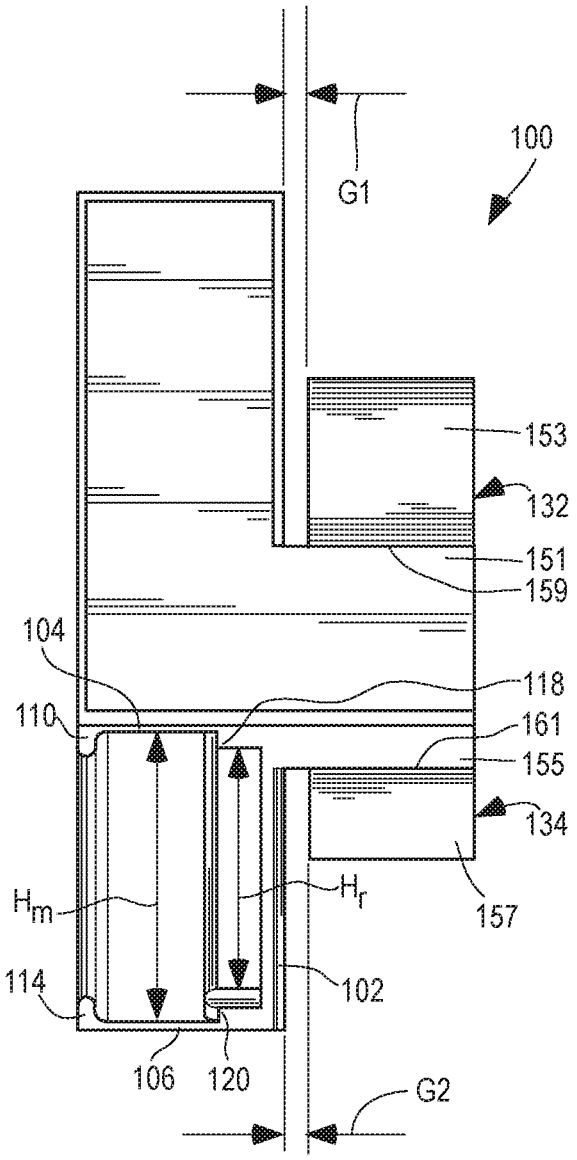
FIG. 3 is a top perspective view of the label holder of FIG. 1, showing the exemplary gaps between the product-gripping panel and the rear panel of the label holder.

FIGS. 1-3 illustrate one embodiment of a label holder 100 for retaining an electronic product label 180 and detachably coupling to a product container 190 such that the electronic product label 180 is visible to a user (e.g., a worker at a retail store, distribution center, etc.). The product container 190 may include, but is not limited to, a box (e.g., a cardboard box) that is conventionally used to store and/or transport general-purpose consumer products and/or consumable goods. An exemplary product container 190 illustrated in FIG. 1 includes a top wall 192, a side wall 194, and a front wall 196. The electronic product label 180 may include any digital label, for example, an electronic shelf label (ESL), Digital Inventory Prep Label (DIPL), or the like. The exemplary electronic product label 180 illustrated in FIG. 1 may include a bar code 182 that facilitates an identification of the products located in the product container 190, as well as a display screen 184 that may display the name of the products, unit price of the products, other identifying information (e.g., SKU), or the like. The label holder 100 may be made from polymer-based materials, and includes one or more polymers, co-polymers, and/or plastic materials.

The exemplary label holder 100 includes a rear panel 102 having a forward-facing surface 103 and a rearward-facing surface 105. The rear panel 102 of the exemplary label holder 100 of FIG. 2 is shown as being generally rectangular in shape by way of example only, and it will be appreciated that the label holder 100 may be configured such that the rear panel 102 has a different shape, for example, square, trapezoidal, circular, oval, etc. In addition, the exemplary rear panel 102 shown in FIG. 2 includes a triangular cutout 107, another triangular cutout 109, and a trapezoidal cutout 111. It will be appreciated that the sizes and shapes of the cutouts 107, 109, 111 are shown by way of example only, and that, in some embodiments, the rear panel 102 may include more cutouts (e.g., 4, 5, etc.), or less cutouts (e.g., 2, 1, or 0).

The label holder 100 according to the embodiment shown in FIG. 1, includes a top panel 104 and a bottom panel 106, which are attached to the rear panel 102 and extend in a generally forward direction relative to the rear panel 102. The top panel 104 and the bottom panel 106 are shown as being perpendicular to the rear panel 202 in FIG. 1 by way of example only, and it will be appreciated that, in some implementations (e.g., depending on the shape of the electronic product label 180 that will be retained in the label holder 100), one or both of the top and bottom panels 104, 106 may be oriented at an angle that is not perpendicular to the rear panel 102.

As can be seen in FIGS. 1 and 2, the rear panel 102, the top panel 104, and the bottom panel 106 together define a channel 108 that is configured to receive (e.g., slidably at each end of the channel) and retain the electronic product label 180. While the channel 108 is shown in FIG. 2 as being generally U-shaped, the channel 108 may be configured to have any shape that is suitable to receive one of a variety of electronic product labels 180. For example, the channel 108 may have a shape that is generally rectangular, square, or the like. In some aspects, the channel 108 may be sized and shaped to receive a generally rectangular electronic product label 180 that is about 60-70 (e.g., 65) mm long, 35-45 (e.g., 39) mm high, and 35-45 (e.g., 40) mm deep.

With reference to FIG. 2, the top panel 104 of the exemplary label holder 100 includes a flange 110 extending therefrom. In the exemplary embodiment shown in FIG. 2, the flange 110 extends downwardly and perpendicularly relative to the top panel 104 and terminates in a distal end 112. Similarly, the bottom panel 106 of the exemplary label holder 100 includes a flange 114 extending therefrom. In the exemplary embodiment shown in FIG. 2, the flange 114 extends upwardly and perpendicularly relative to the bottom panel 106 and terminates in a distal end 116. As shown in FIG. 2, the distal end 112 of the flange 110 of the top panel 104 and the distal end 116 of the flange 114 of the bottom panel 106 are spaced apart to define a space S (shown in FIG. 1) therebetween. As shown in FIG. 1, a front face (including the bar code 182 and display 184) of the electronic product label 180 may be visible to a worker of a retail facility through the space S between the distal end 112 of the flange 110 and the distal end 116 of the flange 114.

In the embodiment shown in FIG. 2, the channel 108 of the label holder 100 includes a top step 118 at an intersection of the rear panel 102 and the top panel 104, and a bottom step 120 at an intersection of the rear panel 102 and the bottom panel 106. As such, the channel 108 has a maximum height Hm (shown in FIG. 3) as defined by the distance between the top panel 104 and the bottom panel 106, and a reduced height Hr (shown in FIG. 3) as defined by the distance between the top step 118 and the bottom step 120. It will be appreciated that the top step 118 and the bottom step 120 are optional depending on the shape of the electronic product label 180 to be inserted into the channel 108, and that, in some implementations, the channel 108 may be configured such that one or both of the top and bottom steps 118, 120 omitted (e.g., FIG. 5), enlarged, or reduced.

As can be seen in FIG. 1, when the electronic product label 180 is inserted into (e.g., by being slid into either one of the ends of) the channel 108 of the label holder 100, the electronic product label 180 is securely retained in the channel 108 because the flange 110 of the top panel 104 and the flange 114 of the bottom panel 106 provide abutment surfaces that restrict the electronic product label 180 from being removed from (or falling out of) the channel 108 through the space S in a forward direction relative to the rear panel 102.

The exemplary label holder 100 further includes a container-gripping panel 130 attached to the rear panel 102 and extending from the rear panel 102. FIG. 2 shows that the container-gripping panel 130 of the exemplary label holder 100 includes a plurality of projections 136 extending therefrom and configured to grip at least one wall (e.g., 192, 194, 196, etc.) of the product container 190 to detachably couple the label holder 100 to the product container 190.

As shown in FIG. 1, the exemplary container-gripping panel 130 of the label holder 100 is configured to facilitate the detachable coupling of the label holder 100 to a corner of the product container 190, such that some of the projections 136 grip a top wall of the product container 190 and some of the projections 136 grip a side wall 194 of the product container 190. The exemplary label holder 100 shown in FIG. 2 includes a first container-gripping portion 132 including a downward-facing surface 133 having a plurality of the projections 136 extending therefrom. When the label holder 100 is detachably coupled to the product container 190 as shown in FIG. 1, the projections 136 extending from the first container-gripping portion 132 grip a top wall 192 of the product container 190. The label holder4 100 shown in FIG. 2 also includes a second container-gripping portion 134 including an inward-facing surface 135 having a plurality of the projections 136 extending therefrom. When the label holder 100 is detachably coupled to the product container 190 as shown in FIG. 1, the projections 136 extending from the second container-gripping portion 134 grip the side wall 194 of the product container 190.

The projections 136 may be arranged in various patterns on a side of the container gripping portion 132 that faces toward the walls (e.g., 192 and 194) of the product container 190 when the label holder 100 is detachably coupled to the product container 190 as shown in FIG. 1. In the exemplary embodiment shown in FIG. 2, the projections 136 extending from the first container-gripping portion 132 are oriented in three rows, with the first row (which is closest to the rearward-facing surface 105 of the rear panel 102) including two projections 136, the third row (which is furthest from the rearward-facing surface 105 of the rear panel 102) also including two projections 136, and the second row (which is located between the first and third rows) including four projections 136. FIG. 2 also shows that the projections 136 extending from the second container-gripping portion 134 are oriented in three rows, with the first row (which is closest to the rearward-facing surface 105 of the rear panel 102) including two projections 136, the third row (which is furthest from the rearward-facing surface 105 of the rear panel 102) also including two projections 136, and the second row (which is located between the first and third rows) also including two projections 136. It will be appreciated that the sizes of the projections 136, the number of rows of the projections 136, and the number of projections 136 per row have been illustrated in FIG. 2 by way of example only, and that, depending on the size of the product container 190 and/or the electronic product label 180, the container-gripping panel 130 may be configured in other embodiments to have smaller or larger projections 136, to have more or less rows of the projections 136 than shown in FIG. 2, and to have more or less projections 136 per row than shown in FIG. 2.

As can be seen in FIG. 2, each of the projections 136 includes a plurality of facets 138 that converge from their respective bases 140 to form a sharpened peak 142 at a distal end of each of the projections 136. It will be appreciated that the peaks 142 of the projections 136 are shown to be as being sharpened by way of example only, and that the sharpened peaks 142 may be truncated or cut off to form projections 136 having a generally flat peak. Generally, the sharpened peaks 142 of the projections 136, when engaged to one or more walls of the product container 190 (as shown in FIG. 1) grip the walls of the product container 190 and resist dislodgement of the label holder 100 from the walls of the product container 190. In some aspects, the projections 136 grip the walls of the product container 190 and resist dislodgement of the label holder 100 from the walls of the product container 190 by simply being in contact with the surfaces of the product container 190 (i.e., without causing any deviations in the surface of the walls of the product container 190). In some aspects, the projections 136 grip the walls of the product container 190 and resist dislodgement of the label holder 100 from the walls of the product container 190 by projecting into the surfaces of the product container 190 and creating pressure-caused deviations in the surface of the walls of the product container 190 without puncturing the walls of the product container 190.

In the embodiment illustrated in FIG. 2, each of the projections 136 of the first container-gripping portion 132 includes a first side facet 137 that is oriented at an angle that is less than 90 degrees relative to a downward-facing surface 133 of the first container-gripping portion 132, and a second side facet 139 oriented at an angle that is greater than 90 degrees relative to the downward-facing surface 133 of the first container-gripping portion 132. Similarly, each of the projections 136 of the second container-gripping portion 134 includes an upward-facing facet 137 oriented at an angle that is less than 90 degrees relative to an interior-facing surface of the second container-gripping portion 134, and a downward-facing facet 139 oriented at an angle that is greater than 90 degrees relative to the interior-facing surface of the second container-gripping portion 134. As can be seen in FIG. 2, as a result of the relative angles of the facets 137 and 139, the length (as measured by the distance from the base 140 to the peak 142) of the facet 137 (as measured by the distance from the base 140 to the peak 142) is shorter than the length (as measured by the distance from the base 140 to the peak 142) of the facet 139.

As a result of the orientation of the facets 138 and the peak 142 of each of the projections 136 extending from the first and second container-gripping portions 132, 134 is located outside of a perimeter defined by the respective bases of the projections 136. Without wishing to be limited by theory, the relative orientation of the facets 137 and 139, and the resulting orientation of the peaks 142 of the projections 136 as shown in the exemplary embodiment of FIG. 2, are believed to facilitate stronger resistance to dislodgment of the label holder 100 from the walls (i.e., 92 and 94) of the product container 190 when the label holder 100 is detachably coupled to the product container 190 as shown in FIG. 1. However, it will be appreciated that in some aspects, the container-griping panel 130 may include projections 136 including facets 138 having identical dimensions and that are all oriented at identical angles relative to their respective surfaces 133 and 135 of the container-gripping panel 130.

In some embodiments, the exemplary first container-gripping portion 132 includes a first segment 151 and a second segment 153 oriented at an angle relative to the first segment 151 such that the second segment 153 extends in a downwardly direction relative to the first segment 153 as shown in FIG. 2. Similarly, the second container-gripping portion 134 includes a first segment 155 and a second segment 157 oriented at an angle relative to the first segment 155 such that the second segment 157 extends in an inwardly direction relative to the first segment 155 as shown in FIG. 2. In some aspects, the second segment 153 of the first container-gripping portion 132 and the second segment 157 of the second gripping portion 134 are movable relative to the rear panel 102 of the label holder 100 and relative to each other, and are biased for movement in a direction toward each other. In the exemplary embodiment shown in FIG. 3, the second segment 153 of the first container-gripping portion 132 is not directly attached to the rear panel 102 of the label holder 100, but is spaced from the rear panel 102 by a gap G1. Similarly, in the exemplary embodiment shown in FIG. 3, the second segment 157 of the second container-gripping portion 134 is not directly attached to the rear panel 102 of the label holder 100, but is spaced from the rear panel 102 by a gap G2. Notably, the sizes of the gaps G1 and G2 are being shown by way of example only, and the gaps G1 and G2 may be larger or smaller in other embodiments.

Thus, a user (e.g., a worker at a retail store, distribution center, etc.) who intends to detachably couple the label holder 100 to the product container 190 may pull the second segment 153 of the first container-gripping portion 132 and the second segment 157 of the second container-gripping portion 134 in a direction away from each other (i.e., by pivoting the second segment 153 in a generally upwardly direction about a hinge 159 and relative to the rear panel 102 and pivoting the second segment 157 in a generally inwardly direction about a hinge 161 and relative to the rear panel 102). As such, the container-gripping panel 130 is brought into a substantially L-shaped configuration and orienting the peaks 142 of the projections 136 such that a corner (e.g., the upper-right corner) of the product container 190 may be inserted between the first container-gripping portion 132 and the second container-gripping portion 134. Then, the user may release the second segment 153 of the first container-gripping portion 132 and the second segment 157 of the second gripping portion 134, which causes (i.e., due to the biased relationship of the second segment 153 and the second segment 157) the projections 136 of the second segment 153 to snap onto and grip the top wall 192 while also causing the projections 136 of the second segment 157 to snap onto and grip the side wall 194, thereby securely (albeit removably) attaching the label holder 100 to the product container 190 and resisting accidental dislodgment of the label holder 100 from the product container 190.

Figure 6:
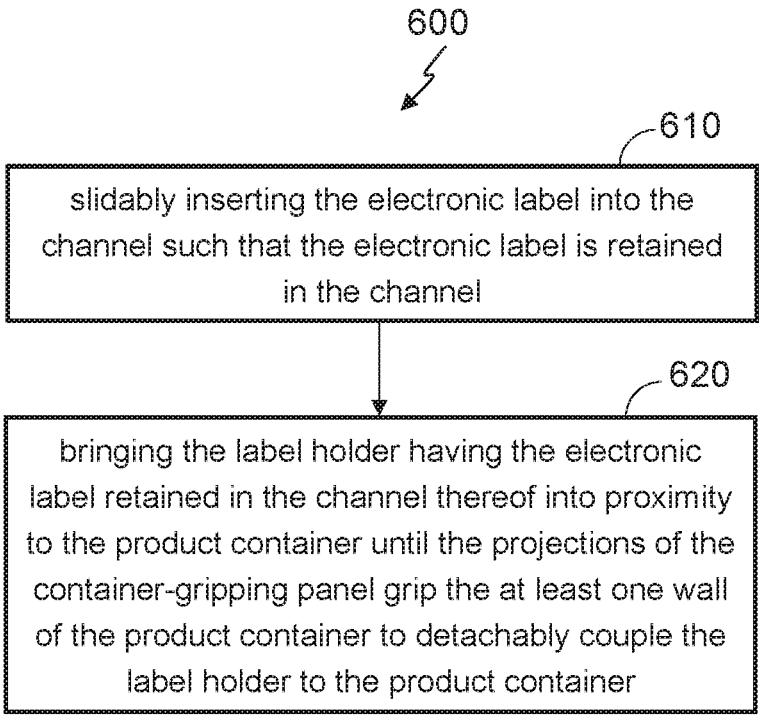
FIG. 6 is a flow diagram of a method of detachably attaching the label holder of claim 1 to the product container in accordance with some embodiments.

As shown in FIG. 6, in one exemplary method 600 of detachably attaching the label holder 100 to the product container 190, a user (e.g., a worker at a retail store, distribution company, shipping company, etc.) who intends to detachably attach the label holder 100 to the product container 190 would slidably insert the electronic product label 180 into the channel 108 of the label holder 100, such that the electronic product label 180 is retained in the channel 108 (step 610). Then, with the electronic product label 180 being retained in the channel 108, the exemplary method 600 includes the user bringing the label holder 100 into proximity relative to the product container 190 until the projections 136 of the container-gripping panel 130 grip at least one wall of the product container 190 to detachably couple the label holder 100 to the product container 190 (step 620).

In some aspects, the step of bringing the label holder 100 into proximity relative to the product container 190 includes bringing the label holder 100 having the electronic product label 180 retained in the channel 108 into proximity to the product container 190 until the projections 136 extending from the first container-gripping portion 132 grip the top wall 192 of the product container 190 and the projections 136 extending from the second container-gripping portion 134 grip a side wall 194 of the product container 190. In one aspect, as discussed above, bringing the label holder 100 into proximity to the product container 190 until the projections 136 extending from the first container-gripping portion 132 grip the top wall 192 of the product container 190 and the projections 136 extending from the second container-gripping portion 134 grip a side wall 194 of the product container 190 includes moving (e.g., pulling, pivoting, etc.) the first and second container-gripping portions 135 in a direction away from each other in order to provide enough clearance for the corner of the product container 190 to pass between the projections 136 of the container-gripping panel 130 as shown in FIG. 1.

Figure 4:
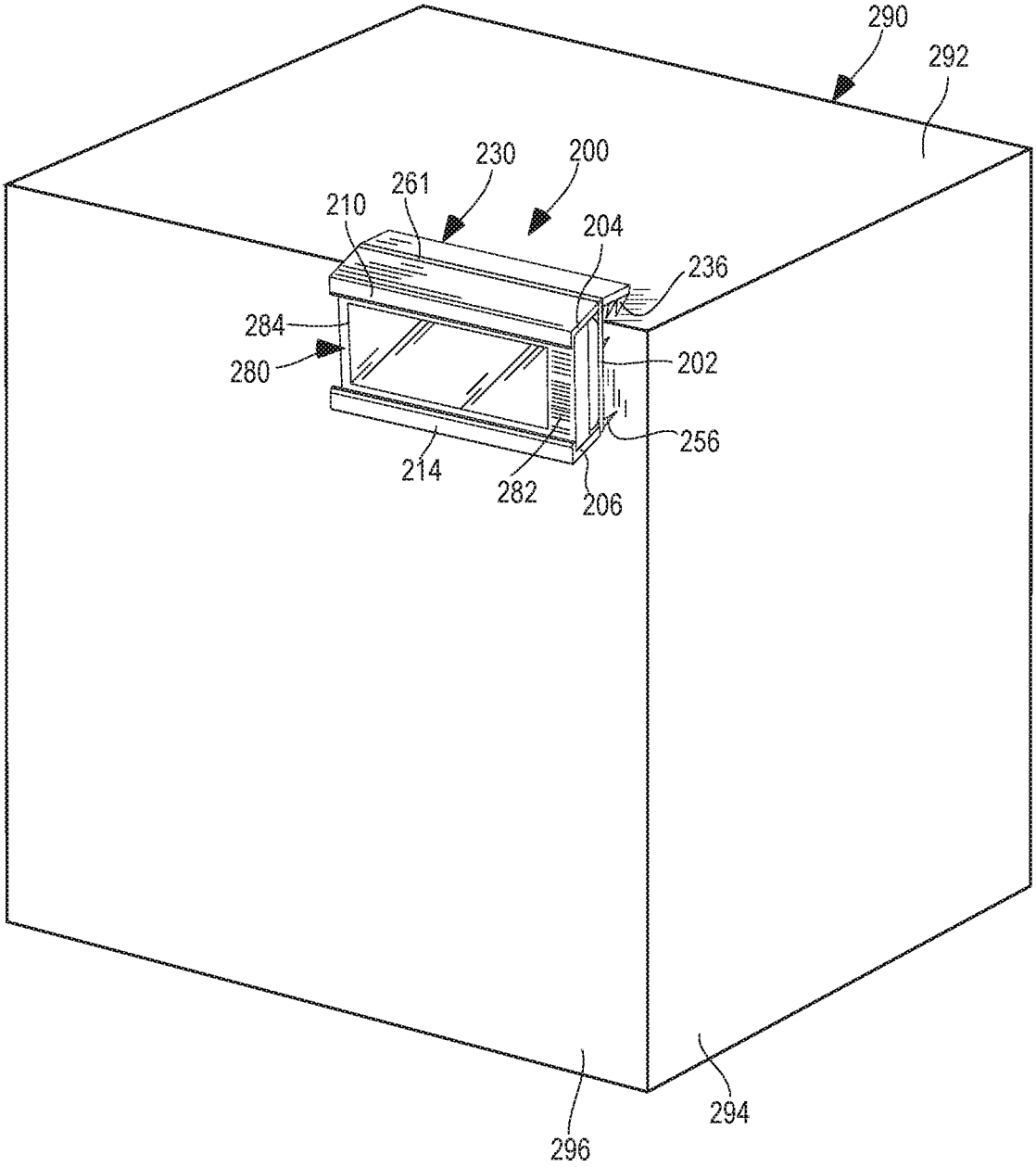
FIG. 4 is a front perspective view of a label holder in accordance with some embodiments, shown while retaining an electronic product label and being detachably coupled to a top wall and a front wall of the product container.
Figure 5:
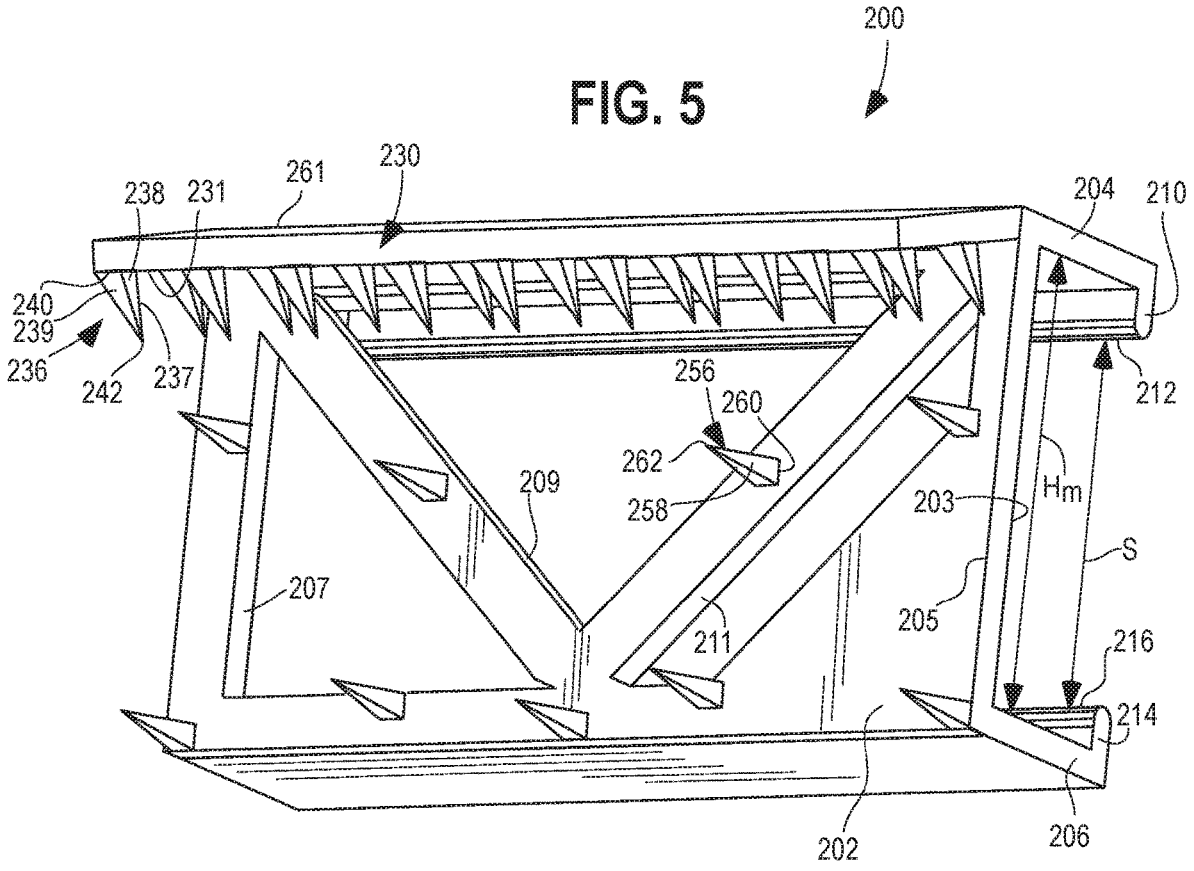
FIG. 5 is a rear perspective view of the label holder of FIG. 4, showing the product-gripping panel of the label holder and the product container-gripping projections extending therefrom, as well as showing the projections extending from the rear panel of the label holder.

FIGS. 4 and 5 illustrate another embodiment of a label holder 200 for retaining an electronic product label 280 and detachably coupling to a product container 290. The label holder 200 includes a number of features that are similar to the features of the label holder 100. For ease of reference, aspects of the label holder 100 that are similar to aspects of the label holder 200 have been designated with similar reference numbers, but prefaced with an "2" instead of a "1."

With reference to FIG. 2, similarly to the rear panel 102 of the label holder 100 of FIG. 2, the rear panel 202 of the label holder 200 is generally rectangular in shape. It will be appreciated, however, that the label holder 200 may be configured such that the rear panel 202 has a different shape, for example, square, trapezoidal, circular, oval, etc. In addition, similarly to the rear panel 102 of FIG. 2, the rear panel 202 shown in FIG. 5 includes a triangular cutout 207, another triangular cutout 209, and a trapezoidal cutout 211. It will be appreciated that the sizes and shapes of the cutouts 207, 209, 211 are shown by way of example only, and that, in some aspects, the rear panel 102 may include more (e.g., 4, 5, etc.) or less (e.g., 2, 1, or 0) cutouts.

With reference to FIG. 5, similarly to the label holder 100, the label holder 200 includes a top panel 204 and a bottom panel 206 that are attached to the rear panel 202 and extend in a generally forward direction relative to the rear panel 202. The top panel 204 and the bottom panel 206 are shown in FIG. 5 as being perpendicular to the rear panel 202 by way of example only, and it will be appreciated that, in some implementations (e.g., depending on the shape of the electronic product label that will be retained in the label holder 200), one or both of the top and bottom panels 204, 206 may be oriented at an angle that is not perpendicular to the rear panel 202.

As can be seen in FIG. 5, the rear panel 202, the top panel 204, and the bottom panel 206 together define a channel 208 akin to the channel 108 of the label holder 100. The channel 108 is configured to receive (e.g., slidably at each end of the channel) and retain the electronic product label 280. While the channel 208 is shown in FIG. 5 as being generally U-shaped similarly to the channel 108 of the label holder 100, the channel 208 may be configured to have any shape that is suitable to receive one of a variety of electronic product labels 280. For example, the channel may have a shape that is generally rectangular, square, or the like. Similarly to the channel 108, the channel 208 may be sized and shaped to receive a generally rectangular electronic product label 180 that is about 60-70 (e.g., 65) mm long, 35-45 (e.g., 39) mm high, and 35-45 (e.g., 40) mm deep.

With reference to FIG. 5, the top panel 204 of the exemplary label holder 200 includes a flange 210 extending therefrom. In the exemplary embodiment shown in FIG. 5, the flange 210 extends downwardly and perpendicularly relative to the top panel 206 and terminates in a distal end 212. Similarly, the bottom panel 206 of the exemplary label holder 200 includes a flange 214 extending therefrom. In the exemplary embodiment shown in FIG. 5, the flange 214 extends upwardly and perpendicularly relative to the bottom panel 206 and terminates in a distal end 216. As can be seen in FIG. 5, the distal end 212 of the flange 210 of the top panel 204 and the distal end 216 of the flange 214 of the bottom panel 206 are spaced apart to define a space S (shown in FIG. 5) therebetween. As shown in FIG. 4, a front face 282 of the electronic product label 280 may be visible to a worker of a retail facility through the space S between the distal end 212 of the flange 210 and the distal end 216 of the flange 214.

One difference between the exemplary label holder 100 illustrated in FIG. 2 and the exemplary label holder 200 illustrated in FIG. 5 is that the channel 208 of the label holder 200 does not include a top step (akin to step 118 of the label holder 100) at an intersection of the rear panel 202 and the top panel 204, or a bottom step (akin to step 120 of the label holder 100) at an intersection of the rear panel 202 and the bottom panel 206. As such, the channel 208 has a maximum height Hm (shown in FIG. 5) between the top panel 204 and the bottom panel 206, but does not have a section having a reduced height (akin to the section of the label holder 100 having the reduced height Hr between the top step 118 and the bottom step 120).

It will be appreciated, however, that the label holder 200 is shown in FIG. 5 as not including the steps akin to the steps 118 and 120 by way of example only (to illustrate that the channel 208 may be configured to receive and retain electronic labels 180 of different shapes and sizes). For example, in other embodiments, the label holder 200 may be configured such that the channel 208 includes top and bottom steps that are identical to the top and bottom steps 118 and 120 of the label holder 100, or top and bottom steps that that are larger or smaller than the top and bottom steps 118 and 120 of the label holder 100.

The label holder 200 is similar to the label holder 100 in that when the electronic product label 280 is inserted into (e.g., by being slid into either one of the ends of) the channel 208 of the label holder 200 as shown in FIG. 4, the electronic product label 280 is securely retained in the channel 208 because the flange 210 of the top panel 204 and the flange 214 of the bottom panel 206 provide abutment surfaces that restrict the electronic product label 280 from being removed from (or falling out of) the channel 208 through the space S in a forward direction relative to the rear panel 202.

Like the label holder 100, the label holder 200 includes a container-gripping panel 230 attached to the rear panel 202 and extending from the rear panel 202. FIG. 5 shows that, like the container-gripping panel 130 of the label holder 100, the container-gripping panel 130 of the label holder 200 includes a plurality of projections 236 extending therefrom and configured to grip a wall (e.g., top wall 292) of the product container 290 to detachably couple the label holder 200 to the product container 290. One difference between the label holder 200 and the label holder 100 is that, unlike the container-gripping panel 130, which is configured (e.g., by having the first container-gripping portion 132 and the second container-gripping portion 134) such that its projections 136 simultaneously grip the top wall 192 and the side wall 194 of the product container 190 when the label holder 100 is detachably attached to the product container 190, the container-gripping panel 230 of the label holder 200 is configured such that its projections 236 grip the top wall 192 (but not the side wall 194) of the product container 290 when the label holder 200 is detachably attached to the product container 290.

Another difference between the label holder 100 and the label holder 200 is that, unlike the rear panel 102 of the label holder 100, which in the embodiment shown in FIG. 2 does not have any product container-engaging projections akin to the projections 136 described above extending directly therefrom, the rear panel 202 of the label holder 200 includes multiple projections 256 extending from a rearward-facing surface 203 thereof. In some aspects, the projections 256 of the exemplary label holder 200 are configured to grip a front wall 296 of the product container 290 when the label holder 200 is detachably coupled to the product container 290. It will be appreciated, however, that in some implementations, the label holder 100 may be configured to further include projections (akin to the projections 256) that extend from the rear panel 102 such that the label holder 100 would be configured to simultaneously grip the top wall 192, the side wall 194, and the front wall 196 of the product container 190.

When the exemplary label holder 200 is detachably coupled to the product container 290 as shown in FIG. 4, the projections 256, which do not have an equivalent in the label holder 100, and which extend from the rear panel 202 of the label holder 200, grip the front wall 296 of the product container 190. The combined grip provided by the projections 236 and 256 of the label holder 200 resists dislodgement of the label holder 200 from its detachable attachment to the front wall 296 and the top wall 292 of the product container 290.

The projections 256 may be arranged in various patterns on the rearward-facing surface 205 of the rear panel 202. In the exemplary embodiment shown in FIG. 5, the projections 256 extending from the rearward-facing surface 205 of the rear panel 202 are oriented in two rows, with the first row (which is closer to the top panel 204) including four projections 256 and the second row (which is closer to the bottom panel 206) including five projections 256. It will be appreciated that the sizes of the projections 256, the number of rows of the projections 256, and the number of projections 256 per row have been illustrated in FIG. 5 by way of example only, and that, depending on the size of the product container 290 and/or the electronic product label 280, the rear panel 202 may be configured in other embodiments to have smaller or larger projections 256, to have more or less rows of the projections 256 than shown in FIG. 5, and to have more or less projections 256 per row than shown in FIG. 5.

With reference to FIG. 4, the projections 256 extending from the rearward-facing surface 205 of the rear panel 202 of the label holder 200 are similar to the projections 236 extending from the container-gripping panel 130. For example, just like the projections 236, each of the projections 256 includes a plurality of facets 258 that converge from their respective bases 260 to form a sharpened peak 262 at a distal end thereof. In the embodiment illustrated in FIG. 5, each of the facets 258 of the projections 256 is oriented at a substantially identical obtuse angle relative to the rearward-facing surface 203 of the rear panel 202. As a result of having facets 258 having the orientation and sizes as described above and shown in FIG. 5, the sharpened peak 262 of each of the projections 256 is located within a perimeter defined by the respective bases 260 of each of the projections 256.

Like the projections 136 of the container-gripping panel 130 of the label holder 100, each of the projections 236 extending from the container-gripping panel 230 of the label holder 200 includes a plurality of facets 238 that converge from their respective bases 240 to form a sharpened peak 242 at a distal end of each of the projections 236. It will be appreciated that the peaks 242 of the projections 136 are shown to be as being sharpened by way of example only, and that the sharpened peaks 242 may be truncated or cut off to form projections 236 having a generally flat peak. Generally, the sharpened peaks 242 of the projections 236, when engaged to the top wall 292 of the product container 290 as shown in FIG. 4, grip the top wall 292 of the product container 290 and resist dislodgement of the label holder 200 from the product container 190 by resisting the forward movement of the label holder 200. Similarly to the projections 136, the projections 236 may grip the walls of the product container 290 and resist dislodgement of the label holder 200 from the top wall 292 of the product container 290 by simply being in contact with the surfaces of the top wall 292 without causing any deviations in the surface of the walls of the product container 290. Also similarly to the projections 136, the projections 236 may in some aspects grip the top wall 292 of the product container 290 and resist dislodgement of the label holder 200 from the top wall 292 by projecting into the surface of the top wall 292 and creating pressure-caused deviations in the surface of the top wall 292 without puncturing the top wall 292.

As shown in FIG. 4, each of the projections 236 extending from the container-gripping panel 230 includes a forward-facing facet 237 oriented at an angle that is less than 90 degrees relative to a downward-facing surface 231 of the container-gripping panel 230, and a rearward-facing facet 239 oriented at an angle that is greater than 90 degrees relative to the downward-facing surface 231 of the container-gripping panel 230. As such, the length of the forward-facing facet 237 (as measured from the base 240 to the peak 242 of the projection 236) is less than the length of the rear-facing facet 239 (as measured from the base 240 to the peak 242 of the projection 236). As a result, in the embodiment illustrated in FIG. 5, the sharpened peak 242 of each of the projections 236 is located outside of a perimeter defined by the bases 240 of the four facets of each projection 236 and closer to the rearward-facing surface 205 of the rear panel 202 than both the base 240 of the forward-facing facet 237 and the base 240 of the rearward-facing facet 239. Without wishing to be limited by theory, the relative orientation of the facets 237 and 239, and the resulting orientation of the peaks 242 of the projections 236 as shown in the exemplary embodiment of FIG. 5, are believed to facilitate stronger resistance to dislodgment of the label holder 200 from the top wall 292 of the product container 290 when the label holder 200 is detachably coupled to the product container 290 as shown in FIG. 4. However, it will be appreciated that in some aspects, the container-griping panel 230 may include projections 236 including facets 238 having identical dimensions and that are all oriented at identical angles relative to the downward-facing surface 231 of the container-gripping panel 230.

As described above with reference to the arrangement of the projections 136 on the container-gripping panel 130 of the label holder 100, the projections 236 may be arranged in various patterns on an underside of the container-gripping panel 230 that would face toward the top wall 292 of the product container 290 when the label holder 200 is detachably coupled to the product container 290 as shown in FIG. 4. In the exemplary embodiment shown in FIG. 5, the projections 236 extending from the exemplary container-gripping panel 230 are oriented in two rows, with the first row (which is closest to the rearward-facing surface 205 of the rear panel 202) including nine projections 236, and the second row (which is further away from the rearward-facing surface 205 of the rear panel 202 than the first row) also including nine projections 236. It will be appreciated that the dimensions of the projections 236, as well as the number of rows of the projections 236, and the number of projections 236 per row have been shown by way of example only, and that the container-gripping panel 230 may be configured in other embodiments to have smaller or larger projections 236, and to have more than two (e.g., 3, 4, etc.) or less than two (e.g., 1) rows of projections 236, and to have more than nine (e.g., 10, 11, 12, etc.) projections 236 per row or less than nine (e.g., 8, 7, 6, etc.) projections per row.

In the embodiment illustrated in FIG. 5, the exemplary container-gripping panel 230 is not parallel to the top panel 204 and is oriented such that it extends in a downwardly direction relative to the top panel 204. In some aspects, the container-gripping panel 230 is movable relative to a hinge 261 and relative to the top panel 204 of the label holder 200, and is biased for movement about a hinge 261 in a downward direction relative to the top panel 204. Thus, a user (e.g., a worker at a retail store, distribution center, etc.) who intends to detachably couple the label holder 200 to the product container 290 may move the container-gripping panel 230 (e.g., by pivoting the container-gripping panel 230 in a generally upwardly direction about the hinge 261 and relative to the rear panel 202). As such, the container-gripping panel 230 is brought into an orientation, where the container-gripping panel 230 is substantially co-linear with the top panel 204 (or where the container-gripping panel 230 projects above the top panel 204 and extends upwardly relative to the top panel 204). As such, the peaks 242 of the projections 236 are positioned such that such portions of the top wall 292 and the front wall 296 of the product container 290 may be inserted between the container-gripping panel 230 and the rear wall 202 of the label holder 200 such that the peaks 262 of the projections 256 extending from the rear panel 202 come into contact with the front wall 296 of the product container 290. Then, the user may release the container-gripping panel 230, which causes (i.e., due to the container-gripping panel 230 being biased relative to the rear panel 202) the projections 236 of the container-gripping panel 230 to snap onto and grip the top wall 292, thereby securely (albeit removably) attaching the label holder 200 to the product container 290 and resisting accidental dislodgment of the label holder 200 from the product container 290.

In one exemplary method of detachably attaching the label holder 200 to a product container 290, a user (e.g., a worker at a retail store, distribution company, shipping company, etc.) who intends to detachably attach the label holder 200 to the product container 290 would slidably insert the electronic product label 280 into the channel 208 of the label holder 200, such that the electronic product label 280 is retained in the channel 208. Then, with the electronic product label 280 being retained in the channel 208, the user would bring the label holder 200 into proximity relative to the product container 290 until the projections 236 extending from the container-gripping panel 230 grip the top wall 292 of the product container 290 and the projections 256 extending from the rear panel 202 grip the front wall 296 of the product container 290.

In some aspects, the step of bringing the label holder 200 into proximity relative to the product container 290 includes bringing the label holder 200 having the electronic product label 280 retained in the channel 208 into proximity to the product container 290 until the projections 236 extending from the container-gripping panel 230 grip the top wall 192 of the product container 190 and the projections 256 extending from rear wall 202 of the label holder 200 grip the front wall 296 of the product container 290. In one aspect, as discussed above, bringing the label holder 200 into proximity to the product container 290 until the projections 236 extending from the container-gripping panel 230 grip the top wall 192 of the product container 190 includes moving (e.g., pulling, pivoting, etc.) the container-gripping panel 230 relative to a hinge 261 in an upward direction relative to the rear panel 202 and the top panel 204 in order to provide enough clearance for the portions of the top wall 292 and the front wall 296 of the product container 290 to pass between the projections 236 of the container-gripping panel 230 and the projections 256 of the rear panel 202, as shown in FIG. 4.

The systems and methods described herein provide for easy and/or automatic reordering of products discarded by the consumers, enabling the consumers to automatically reorder a product that they place into a trash can without having to connect to the internet and/or log into a website. In addition, the systems and methods described herein advantageously enable retail providers to retain consumers by tying the discarding of a product by the consumer to a reorder of the same, substitute, and/or complementary product from a specific retailer provider, enabling the retail provider to retain customers who previously ordered from the retail provider. In addition, the systems and methods described herein may advantageously provide retail providers with data indicating product usage trends of consumers, enabling the retail providers to personalize product offerings to the consumers based on the consumers' product usage. As such, the systems and methods described herein may advantageously save consumers time in reordering products and may enable retail providers to retain their customers and increase their revenue by retaining customers and monetizing known consumer product usage trends.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A label holder for retaining an electronic product label and detachably coupling to a product container, the label holder comprising:

a rear panel;

a top panel and a bottom panel each attached to the rear panel and extending in a forward direction relative to the rear panel; and at least one container-gripping panel movably attached relative to the rear panel and extending from the rear panel;

wherein the rear panel, the top panel, and the bottom panel together define a channel therebetween configured to slidably receive and retain an electronic product label; and wherein the container-gripping panel includes a plurality of projections extending therefrom and configured to grip at least one wall of the product container to detachably couple the label holder to the product container.

2. The label holder of claim 1, wherein the top panel includes a flange extending downwardly therefrom, the flange of the top panel having a distal end;

wherein the bottom panel includes a flange extending upwardly therefrom, the flange of the bottom panel having a distal end; and wherein the distal end of the flange of the top panel and the distal end of the flange of the bottom panel are spaced apart to define a space therebetween configured to permit a front face of the electronic product label to be visible therethrough.

3. The label holder of claim 2, wherein the flange of the top panel and the flange of the bottom panel restrict the electronic product label from being removed from the channel through the space between the distal end of the flange of the top panel and the distal end of the flange of the bottom panel in a forward direction relative to the rear panel.

4. The label holder of claim 1, wherein the channel includes a top step at an intersection of the rear panel and the top panel, and a bottom step at an intersection of the rear panel and the bottom panel; and wherein the channel has a maximum height between the top and bottom panels and a reduced height between the top step and the bottom step.

5. The label holder of claim 1, wherein the projections are oriented in at least a first row and a second row, the first row being closer than then second row to a rearward-facing surface of the rear panel.

6. The label holder of claim 1, wherein each of the projections includes a plurality of facets that converge from their respective bases to form a sharpened peak at a distal end of each of the projections.

7. The label holder of claim 6, wherein the sharpened peak of each of the projections is located outside of a perimeter defined by the respective bases of the facets.

8. The label holder of claim 1, wherein the container-gripping panel includes:

a first container-gripping portion including a plurality of the projections extending therefrom and configured to grip a top wall of the product container when the label holder is detachably coupled to the product container; and a second container-gripping portion including a plurality of the projections extending therefrom and configured to grip a side wall of the product container when the label holder is detachably coupled to the product container.

9. The label holder of claim 8, wherein each of the projections of the first container-gripping portion includes:

a first side facet oriented at an angle that is less than 90 degrees relative to a downward-facing surface of the first container-gripping portion from which the projections extend; and a second side facet oriented at an angle that is greater than 90 degrees relative to an downward-facing surface of the first container-gripping portion; and wherein each of the projections of the second container-gripping portion includes:

an upward-facing facet oriented at an angle that is less than 90 degrees relative to an interior-facing surface of the second container-gripping portion from which the projections extend; and a downward-facing facet oriented at an angle that is greater than 90 degrees relative to the interior-facing surface of the second container-gripping portion.

10. The label holder of claim 8, wherein the first container-gripping portion and the second gripping portion are movable relative to the rear panel of the label holder and are biased for movement in a direction toward each other.

11. The label holder of claim 1, wherein the rear panel further comprises a plurality of projections extending from a rearward-facing surface of the rear panel and configured to grip a front wall of the product container when the label holder is detachably coupled to the product container.

12. The label holder of claim 11, wherein each of the projections extending from the rearward-facing surface of the rear panel includes a plurality of facets that converge from their respective bases to form a sharpened peak at a distal end thereof.

13. The label holder of claim 12, wherein each of the facets is oriented at a substantially identical angle relative to the rearward-facing surface of the rear panel, each of the substantially identical angles being greater than 90 degrees.

14. The label holder of claim 13, wherein the sharpened peak of each of the projections extending from the rearward-facing surface of the rear panel is located within a perimeter defined by the respective bases of the facets.

15. The label holder of claim 11, wherein each of the projections extending from the container-gripping panel includes a forward-facing facet oriented at an angle that is less than 90 degrees relative to a bottom-facing surface of the container-gripping panel; and wherein each of the projections extending from the container-gripping panel includes a rearward-facing facet oriented at an angle that is greater than 90 degrees relative to an downward-facing surface of the container-gripping panel; and wherein the sharpened peak of each of the projections is located closer to the rearward-facing surface of the rear panel than each of a base of the forward-facing facet and a base of the rearward-facing facet.

16. The label holder of claim 11, wherein the top panel is oriented generally perpendicularly relative to the rear panel and generally parallel to the bottom panel; and wherein the container-gripping panel extends from the rearward-facing surface of the rear panel with a downwardly-oriented slope such that the container-gripping panel is not perpendicular to the rear panel or parallel to the top and bottom panels.

17. The label holder of claim 1, further in combination with an electronic product label.

18. A method of detachably attaching the label holder of claim 1 to the product container, the method comprising, slidably inserting the electronic label into the channel such that the electronic label is retained in the channel; and bringing the label holder having the electronic label retained in the channel thereof into proximity to the product container until the projections of the container-gripping panel grip the at least one wall of the product container to detachably couple the label holder to the product container.

19. The method of claim 18, wherein the rear panel further comprises a plurality of projections extending from a rearward-facing surface of the rear panel and configured to grip a front wall of the product container; and wherein the bringing step further comprises bringing the label holder having the electronic label retained in the channel thereof into proximity to the product container until the projections of the container-gripping panel grip the front wall of the product container.

20. The method of claim 18, wherein the container-gripping panel includes:

a first container-gripping portion including a plurality of the projections extending therefrom and configured to grip a top wall of the product container when the label holder is detachably coupled to the product container; and a second container-gripping portion including a plurality of the projections extending therefrom and configured to grip a side wall of the product container when the label holder is detachably coupled to the product container; and wherein the bringing step further comprises bringing the label holder having the electronic label retained in the channel thereof into proximity to the product container until the projections extending from the first container-gripping portion grip the top wall of the product container and the projections extending from the second container-gripping portion grip a side wall of the product container.

* * * * *